US011673191B2

(12) United States Patent
Williamson et al.

(10) Patent No.: US 11,673,191 B2
(45) Date of Patent: Jun. 13, 2023

(54) METHOD OF MAKING A CAPSULE FOR HOT ISOSTATIC PRESSING

(71) Applicant: BODYCOTE IMT, INC., Dallas, TX (US)

(72) Inventors: Byron Williamson, Dallas, TX (US); Robert Pagliuso, Dallas, TX (US); Alex Rutfield, Dallas, TX (US)

( * ) Notice: Subject to any disclaimer, the term of this patent is extended or adjusted under 35 U.S.C. 154(b) by 190 days.

(21) Appl. No.: 17/046,933

(22) PCT Filed: Apr. 1, 2019

(86) PCT No.: PCT/IB2019/052667
§ 371 (c)(1),
(2) Date: Oct. 12, 2020

(87) PCT Pub. No.: WO2019/197936
PCT Pub. Date: Oct. 17, 2019

(65) Prior Publication Data

US 2021/0146436 A1 May 20, 2021

Related U.S. Application Data

(60) Provisional application No. 62/655,366, filed on Apr. 10, 2018.

(51) Int. Cl.

| | |
|---|---|
| ***B22F 3/15*** | (2006.01) |
| ***B22F 3/12*** | (2006.01) |
| ***C21D 9/46*** | (2006.01) |

(52) U.S. Cl.
CPC ..... *B22F 3/15* (2013.01); *B22F 3/1283* (2013.01); *C21D 9/46* (2013.01); *B22F 2003/153* (2013.01); *C21D 2241/02* (2013.01)

(58) Field of Classification Search
CPC .... B22F 3/15; B22F 3/1283; B22F 2003/153; C21D 9/46; C21D 2241/02
See application file for complete search history.

(56) References Cited

U.S. PATENT DOCUMENTS 4,077,109 A * 3/1978 Larson ..... B22F 3/1258 419/49
4,889,276 A * 12/1989 Cadwell ..... B23K 20/00 228/235.1

(Continued)

FOREIGN PATENT DOCUMENTS

JP S5458606 5/1979
JP S62116704 5/1987

(Continued)

OTHER PUBLICATIONS

Written Opinion and International Search Report cited in PCT/IB2019/052667 dated Jul. 16, 2019, 10 pages.
Japanese Office Action dated Jan. 13, 2023, and Translation.

*Primary Examiner* — Anthony J Zimmer
*Assistant Examiner* — Ricardo D Morales
(74) *Attorney, Agent, or Firm* — Shumaker, Loop & Kendrick, LLP; S. Alexander Long, Jr.

(57) ABSTRACT

A method of making a capsule 2 for hot isostatic pressing (HIPing) comprises: (i) selecting a first sheet of metal; (ii) subjecting the first sheet to a forming process, for example die forming, thereby to define a first member 4*a* of the capsule; (iii) securing said first member to one or more other members thereby to define at least part of a capsule for HIPing.

20 Claims, 3 Drawing Sheets

(56) References Cited

U.S. PATENT DOCUMENTS

| | | | | |
|---|---|---|---|---|
| 6,210,633 | B1 * | 4/2001 | Kratt | B22F 3/1258 419/49 |
| 2013/0115126 | A1 * | 5/2013 | Hood | B30B 15/022 419/49 |
| 2013/0199693 | A1 * | 8/2013 | Tank | B05B 1/00 175/371 |
| 2017/0036297 | A1 | 2/2017 | Heck | |

FOREIGN PATENT DOCUMENTS

| | | | |
|---|---|---|---|
| JP | 05-031539 | A | 2/1993 |
| JP | 2017-82323 | A | 5/2017 |

* cited by examiner

METHOD OF MAKING A CAPSULE FOR HOT ISOSTATIC PRESSING

CROSS-REFERENCE TO RELATED APPLICATION

This application is a non-provisional application tracing priority and claiming benefit to PCT/IB2019/052667 with the international filing date of Apr. 1, 2019, entitled "A METHOD OF MAKING A CAPSULE FOR HOT ISOSTATIC PRESSING", which itself traces priority and claims benefit to U.S. Provisional Application No. 62/655,366, filed Apr. 10, 2018, entitled "A METHOD OF MAKING A CAPSULE FOR HOT ISOSTATIC PRESSING", the entirety of which is expressly incorporated herein by reference.

The invention relates to components and particularly, although not exclusively, relates to a method of making a capsule for powder metallurgy (PM) Hot Isostatic Pressing (HIP). The invention also relates to a capsule per se, a method of producing a HIPed component and a HIPed component per se.

It is well known to produce relatively complex shaped components using powder metallurgy (PM) Hot Isostatic Pressing (HIP). HIP is an established manufacturing method, where a metal sheet capsule encapsulates and defines the shape of metal powder, which is then subject to HIP consolidation, to produce a single, component with homogenous microstructural and mechanical properties. To form a capsule for HIP, metal sheet is cut and bent to define parts of the capsule which are then welded together. However, the greater the number of welds used to define a capsule, the greater the risk one weld will fail, rendering the capsule unusable in a HIP process. In addition, the greater the number of welds used to produce a capsule, the greater the risk a capsule produced may be out of tolerance. This is because, for each weld, there will be a degree of error in its location. Each additional weld compounds the potential error.

Other problems associated with capsules used to produce components by HIP will be apparent from the description which follows.

It is an object of the invention to address the above-described problems.

According to a first aspect of the invention, there is provided a method of making a capsule for hot isostatic pressing (HIPing), the method comprising:

(i) selecting a first sheet of metal;

(ii) subjecting the first sheet to a forming process thereby to define a first member of the capsule;

(iii) securing said first member to one or more other members thereby to define at least part of a capsule for HIPing.

In step (i), said metal may comprise a steel, but is not limited to, for example mild or stainless steel or aluminium. Said metal is preferably formable; it is preferably suitable for cold forming. Said metal preferably comprises a cold-rolled steel.

Said metal, for example steel, may have a maximum yield strength (Re) of at least 100 $N/mm^2$, preferably at least 150 $Nmm^2$. The maximum yield strength may be less than 300 $N/mm^2$, preferably less than 280 $N/mm^2$.

Said metal, for example steel, may have a tensile strength (Rm) in the range 250-400 $N/mm^3$.

Said first sheet of metal selected in step (i) may have a thickness of at least 1 mm, preferably at least 2 mm. The thickness may vary, dependent on geometry of die. It is preferably 5 mm or less. Said first sheet is preferably substantially planar. It preferably has a substantially constant thickness across its extent.

Said first sheet of metal may have a face having an area of at least 0.25 $m^2$, at least 0.5 $m^2$ or at least 1 $m^2$. The area of the face may be less than 4 $m^2$.

In step (ii), said first sheet may be subjected to a forming process, suitably using a die, suitably with a predetermined geometry for defining regions in an outer surface of the first member to be defined in the method. In the forming process, a force is suitably applied to the first sheet to force it into the die so it adopts the shape of the die. A fluid may be used in application of the force to the first sheet to force it into the die. The method may comprise using the same die to produce a plurality (e.g. at least 3, at least 5 or at least 10) of substantially identical first members.

Step (ii) of the method preferably comprises die forming the first sheet of metal. The forming process may be selected from flex-forming, deep drawing, spin-forming and hydro forming. Hydroforming may be preferred.

In the method, preferably a single sheet of metal is used to define said first member.

Said first member preferably includes no weld lines or welded areas. Said first member is preferably unitary. Said first member is preferably monolithic. Said first member preferably has a substantially constant thickness across its extent. Said first member preferably includes at least three, at least four, at least five, at least six or at least seven outwardly facing (e.g. so as to define an outer surface of a capsule incorporating the first member in use) curved areas. The curved areas described are preferably distinct. A number of the curved areas may be contiguous to one another.

One or a plurality, preferably each, curved area may be part circular, for example arcuate (or especially semi-circular), in shape.

Said first member may include a component (A) which is curved. The curve may be regular or irregular. The curve may have a radius of curvature which is constant across its extent or the radius of curvature may vary across its extent. Component (A) may be part cylindrical, for example semi-cylindrical. In the context of the present specification, the term "semi-cylindrical" suitably refers to a half of a cylinder which suitably has a semi-circular cross-section. Component (A) may have a radius of curvature of at least 50 mm, for example at least 100 mm. The radius of curvature may be less than 1000 mm, for example less than 600 mm. Component (A) may have a width, suitably measured in a direction which is parallel to the axis of the cylinder, of at least 10 mm, for example of at least 40 mm. The width may be less than 200 mm or less than 150 mm.

Said first member may include a component (B) which is curved. The curve may be regular or irregular. The curve may have a radius of curvature which is constant across its extent or the radius of curvature may vary across its extent. Component (A) may be part cylindrical, for example semi-cylindrical. Component (B) may be spaced from component (A), for example by another component of the first member. Component (B) may have a radius of curvature of at least 50 mm, for example at least 100 mm. The radius of curvature may be less than 1000 mm, for example less than 600 mm. Component (B) may have a width, suitably measured in a direction which is parallel to the axis of the cylinder, of at least 10 mm, for example of at least 40 mm. The width may be less than 200 mm or less than 150 mm.

Said first member may include a component (C) which is curved. The curve may be regular or irregular. The curve may have a radius of curvature which is constant across its extent or the radius of curvature may vary across its extent. Component (A) may be part cylindrical, for example semi-cylindrical. Component (C) may be spaced from component (A) and/or component (B), for example by one or more other components of the first member. Component (C) may have a radius of curvature of at least 50 mm, for example at least 100 mm. The radius of curvature may be less than 1000 mm, for example less than 600 mm. Component (C) may have a width, suitably measured in a direction which is parallel to the axis of the cylinder, of at least 10 mm, for example of at least 40 mm. The width may be less than 200 mm or less than 150 mm.

Said first member may include a component (D) which is part frusto conical, for example semi-frusto conical. In the context of the present specification, the term "semi-frusto conical" suitably refers to a half of a frusto cone. Component (D) may be contiguous with component (A), (B) or (C). Component (D) may have a radius of curvature at any point of at least 50 mm, for example at least 100 mm. The radius of curvature at any point may be less than 1000 mm, for example less than 600 mm. Component (D) may have a width, suitably measured in a direction which is parallel to the axis of the cylinder, of at least 10 mm, for example of at least 40 mm. The width may be less than 200 mm or less than 150 mm.

Said first member may include a component (E) which is part frusto conical, for example semi-frusto conical. Said component (E) may be contiguous with component (A), (B) or (C). It may be spaced apart from component (D). Component (E) may have a radius of curvature at any point of at least 50 mm, for example at least 100 mm. The radius of curvature at any point may be less than 1000 mm, for example less than 600 mm. Component (E) may have a width, suitably measured in a direction which is parallel to the axis of the cylinder, of at least 10 mm, for example of at least 40 mm. The width may be less than 200 mm or less than 150 mm.

Said first member may include a component (F) which is part frusto conical, for example semi-frusto conical. Said component (F) may be contiguous with component (A), (B) or (C). Component (F) may have a radius of curvature at any point of at least 50 mm, for example at least 100 mm. The radius of curvature at any point may be less than 1000 mm, for example less than 600 mm. Component (F) may have a width, suitably measured in a direction which is parallel to the axis of the cylinder, of at least 10 mm, for example of at least 40 mm. The width may be less than 200 mm or less than 150 mm.

Said first member may include an outwardly facing convex curve defined between a pair of adjacent components selected from components (A), (B), (C), (D), (E) and (F).

Said first member may include an outwardly facing concave curve defined between a pair of adjacent components selected from components A), (B), (C), (D), (E) and (F).

Said first member may include a plurality of concave curves as aforesaid. Said first member may include a plurality of convex curves as aforesaid.

Said first member may include a component (G) which is annular and/or which may be semi-circular in shape. Component (G) may face in the direction of an elongate axis of the first member. At least three, preferably each of said components (A), (B), (C), (D), (E) and (F) curve around the same elongate axis of the first member.

Said first member may include at least three, at least five, or at least seven bends (and suitably fewer than twelve bends) which are suitably arranged to define components (A), (B), (C), (D), (E), (F) and/or (G). Each of said bends may be the result of bending said first sheet through an angle in the range 5 to 90°, for example 10 to 75°.

In one embodiment, said first member may be symmetrical about an axis, for example an elongate axis thereof. In another embodiment, said first member may not be symmetrical about an axis such as an elongate axis.

The method of the first aspect may include:

(a) selecting a second sheet of metal;

(b) subjecting the second sheet to a forming process thereby to define a second member of the capsule.

In step (a), said metal may have any feature of the metal referred to in step (i).

Said second sheet of metal selected in step (a) may have a thickness of at least 1 mm, preferably at least 2 mm, preferably at least 2 mm. The thickness may be 5 mm or less. Said second sheet is preferably substantially planar. It preferably has a substantially constant thickness across its extent.

Said second sheet of metal may have a face having an area of at least 0.25 $m^2$, at least 0.5 $m^2$ or at least 1 $m^2$. The area of the face may be less than 4 $m^2$.

In step (b), said second sheet may be subjected to a forming process, suitably using a die, suitably with a predetermined geometry for defining regions in an outer surface of the second member to be defined in the method. In the forming process, a force is suitably applied to the second sheet to force it into the die so it adopts the shape of the die. A fluid may be used in application of the force to the second sheet to force it into the die. The forming process may be as described for forming of said first sheet. Hydroforming may be preferred.

In the method, preferably a single sheet of metal is used to define said second member.

Said second member preferably includes no weld lines or welded areas. Said second member is preferably unitary. Said second member is preferably monolithic. Said second member preferably has a substantially constant thickness across its extent. Said second member preferably includes at least three, at least four, at least five, at least six or at least seven outwardly facing (e.g. so as to define an outer surface of a capsule incorporating the second member in use) curved areas. The curved areas described are preferably distinct. A number of the curved areas may be contiguous to one another.

One or a plurality, preferably each, curved area may be part circular, for example arcuate (or especially semi-circular), in shape.

Said second member may include a component (A) which is curved. The curve may be regular or irregular. The curve may have a radius of curvature which is constant across its extent or the radius of curvature may vary across its extent. Component (A) may be part cylindrical, for example semi-cylindrical.

Said second member may include a component (B) which is curved. The curve may be regular or irregular. The curve may have a radius of curvature which is constant across its extent or the radius of curvature may vary across its extent. Component (A) may be part cylindrical, for example semi-cylindrical. Component (B) may be spaced from component (A), for example by another component of the first member.

Said second member may include a component (C) which is curved. The curve may be regular or irregular. The curve may have a radius of curvature which is constant across its extent or the radius of curvature may vary across its extent. Component (A) may be part cylindrical, for example semi-cylindrical. Component (C) may be spaced from component (A) and/or component (B), for example by one or more other components of the second member.

Said second member may include a component (D) which is part frusto conical, for example semi-frusto conical. Component (D) may be contiguous with component (A), (B) or (C).

Said second member may include a component (E) which is part frusto conical, for example semi-frusto conical. Said component (E) may be contiguous with component (A), (B) or (C). It may be spaced apart from component (D).

Said second member may include a component (F) which is part frusto conical, for example semi-frusto conical. Said component (F) may be continuous with component (A), (B) or (C).

Said second member may include an outwardly facing convex curve defined between a pair of adjacent components selected from components (A), (B), (C), (D), (E) and (F).

Said second member may include an outwardly facing concave curve defined between a pair of adjacent components selected from components A), (B), (C), (D), (E) and (F).

Said second member may include a plurality of concave curves as aforesaid. Said second member may include a plurality of convex curves as aforesaid.

Said second member may include a component (G) which is annular and/or which may be semi-circular in shape. Component (G) may face in the direction of an elongate axis of the second member. At least three, preferably each of said components (A), (B), (C), (D), (E) and (F) curve around the same elongate axis of the second member.

In one embodiment, said second member may be symmetrical about an axis, for example an elongate axis thereof. In another embodiment, said second member may not be symmetrical about an axis such as an elongate axis.

The second sheet of step (a) may have any feature of the first sheet of step (i) described. The first and second sheets may or may not be identical.

Step (b) in relation to the second sheet may include any feature undertaken on the first sheet of step (ii). Preferably, the first and second sheets are subjected to substantially identical processes to produce a first member and second member.

When a die is used in step (ii) as described, the same die may be used to make both the first member and the second member.

Said first member and said second member are preferably complementary. Said first and second members are preferably arranged to be mated together. Said first member and said second member each suitably define shells (e.g. with each defining one half of a whole) which may be secured to one another (e.g. in step (iii) of the method), to define at least part of the capsule.

When said first and second members are non-identical, the first member may include one or more structural features which are absent from the second member and vice versa. For example, said first member may incorporate a boss, for example a square boss and said second member may not include an identical boss.

Said first member preferably includes a first elongate edge which may be non-linear and which may extend substantially within a single plane. Said first member may include a second elongate edge, which is suitably diametrically opposed to said first elongate edge, wherein said second elongate edge is non-linear and extends in a single plane which is suitably the same plane in which the first elongate edge extends.

Said second member preferably includes a first elongate edge which may be non-linear and which may extend substantially within a single plane. Said second member may include a second elongate edge, which is suitably diametrically opposed to said first elongate edge, wherein said second elongate edge is non-linear and extends in a single plane which is suitably the same plane in which the first elongate edge extends.

In step (iii) of the method, the first and second elongate edges of the first member are preferably abutted against the first and second elongate edges of the second member and, preferably, abutting edges are suitably secured together, preferably by welding. Elongate weld lines may be defined which extends along the extent of the first and second edges of the first and second members. The weld lines may be substantially diametrically opposed and may extend within a single common plane.

The method may include securing one or more closures to the first member and/or second member to define a substantially closed container. For example, the method may comprise welding a first end piece, for example disc, at or adjacent one end of an assembly comprising first and second members. The method may comprise welding a second end piece, for example disc, at or adjacent an opposite end of the assembly comprising said first and second members.

The substantially closed container may have fewer than ten, fewer than eight, fewer than six or fewer than four, weld lines which are externally visible on viewing the closed container, excluding any weld lines associated with any orifice(s) which is/are arranged to allow access into the void of the container.

The method may include arranging a structure within a void defined within the assembly comprising said first and second members. The structure may include a cylindrical component and/or a frusto-conical component.

In the method, when the first and second members are welded, welding methods may include, but are not limited to, tungsten inert gas (TIG) welding, Metal Inert Gas (MIG) welding or electronbeam welding. Said first and second members (preferably each member) of the capsule is/are preferably secured, for example welded, so that a gas tight (e.g. to helium) seal is defined between the two elements. In the method, preferably, the capsule produced is gas tight (e.g. to helium).

Said capsule made in the method preferably includes one or more orifices for allowing access into the capsule. Said capsule may include an orifice for introducing powder thereinto. It may include an orifice for removing air from the capsule. Any such orifice is preferably sealed prior to the capsule being subjected to HIPing as described herein.

According to a second aspect of the invention, there is provided a capsule per se, made for example as described in the first aspect.

The capsule suitably comprises a first member secured to one or more other members thereby to define at least part of a capsule for HIPing. Said first member and said one or more other members may be as described according to the first aspect. For example, said first member preferably includes no weld lines or welded areas and/or has a substantially constant thickness across its extent and/or includes at least three, at least four, at least five, at least six or at least seven outwardly facing curved areas, wherein one or a plurality, preferably each, curved area may be part circular, for example arcuate, in shape.

Said first member may include a component (A) and/or a component (B) and/or a component (C) and/or a component (D) and/or a component (E) and/or a component (F), each being independently as described according to the first aspect.

Said first member may include a plurality of concave curves and/or a plurality of convex curves each being independently as described according to the first aspect.

Said first member may include a component (G) as described according to the first aspect.

Said first member may include at least three, at least five, or at least seven bends (and suitably fewer than twelve bends) which are suitably arranged to define components (A), (B), (C), (D), (E), (F) and/or (G). Each of said bends may be the result of bending said first sheet through an angle to the range 5 to 90°, for example 10 to 75°.

Said one or more other members suitably includes said second member described according to the first aspect. Said first and second members are preferably substantially identical.

Said capsule may include a structure within a void defined within the assembly comprising said first and second members. The structure may include a cylindrical component and/or a frusto-conical component as described according to the first aspect.

In said capsule, said first and second members (preferably each member) of the capsule is/are preferably secured, for example welded, so that a gas tight (e.g. to helium) seal is defined between the two elements. In the method, preferably, the capsule produced is gas tight (e.g. to helium).

Said capsule preferably includes one or more orifices for allowing access into the capsule. Said capsule may include an orifice for introducing powder thereinto. It may include an orifice for removing air from the capsule.

According to a third aspect of the invention, there is provided a method of producing a component (herein a "HIPed component"), the method comprising:

(i) selecting a capsule as described according to the first and/or second aspects;

(ii) subjecting the capsule to HIP.

Prior to step (ii), said capsule may be tested, suitably to confirm that it is gas-tight. This may comprise introducing (for example via said opening which is arranged to provide access from outside the capsule into the capsule) a gas, for example helium, into the void defined in the capsule and assessing if any of the gas leaks from the capsule.

If the capsule selected does not include powder (XX), the method may comprise introducing powder (XX) into the void of the capsule.

The capsule, suitably containing powder (XX) in said void, may be vibrated, preferably to achieve a known fill weight of powder (XX) and an optimum packaging density.

Prior to step (ii), the method preferably comprises evacuating the capsule, for example the void defined in the capsule. A vacuum may be drawn in the capsule for example by attachment of a vacuum device to an opening which is arranged to provide access into the capsule. After evacuation of the capsule, the method preferably comprises sealing the capsule, for example closing said opening which is arranged to provide access into the capsule.

Step (ii) preferably comprises placing the capsule in a HIP system and subjecting it to a predetermined pressure (e.g. ranging between 100-200 MPa) and temperature (e.g. ranging between 500-1250° C.) for a predetermined time, for example based on material wall thickness and overall weight of the component.

Step (ii) is preferably undertaken to achieve 100% density of powder (XX).

Subsequent to step (ii), the method preferably comprises placing the capsule in a conventional heat treatment furnace for heat treatment followed by aging or precipitation hardening to achieve optimum material properties for the component.

Subsequent to step (ii) part (or preferably the entirety) of the capsule may be removed, suitably to leave a post-treated component comprising consolidated and HIPed powder (XX).

Removal of part of the capsule as aforesaid may be by machining. Advantageously, removal may be by dissolution, for example by use of acid etching. Said first member may be removed. Said second member may be removed. All sheet materials incorporated into the capsule may be removed.

Suitably, after removal of part(s) of the capsule, the component is subjected to minimal machining. This is possible because the capsule is arranged to produce a near net shape. Suitably less than 50%, preferably less than 25%, more preferably less than 10% of the outer surface area of the component is treated, for example machined after removal of parts of the capsule which are not included in the final component. Preferably, after removal of part(s) of the capsule (e.g. sheet materials) which are not included in the final component, the component is not subjected to any process which is arranged to change its shape. Preferably, after removal of parts(s) of the capsule which are not included in the final component, the component is not subjected to any process which may preferentially remove any part of the component in preference to any other part of the component.

After removal of part(s) of the capsule, the component may be subjected to a process which treats substantially the entirety of at least the outer accessible surface of the component in the same manner. For example, the process may comprise a polishing and/or cleaning process.

The component made in the method may define a final component which defines, or is used in, an apparatus, machine or device which may be used in an industrial process.

According to a fourth aspect of the invention, there is provide a HIPed component per se, which is preferably made as described according to the third aspect. The HIPed component itself is believed to be novel by virtue of its method of production. For example, said HIPed component may include two parallel, axially extending, diametrically spaced apart lines or areas defined (or apparent) in the outer surface of the HIPed component. The lines or areas may extend along at least 70%, at least 90% or at least 98% of the length of the HIPed component.

Said HIPed component may include a region (A) which is curved, for example cylindrical and may be defined in the method of the first aspect by respective components (A) of the first and second members.

Said HIPed component may include a region (B) which is curved, for example cylindrical and may be defined in the method of the first aspect by respective components (B) of the first and second members.

Said HIPed component may include a region (C) which is curved, for example cylindrical and may be defined in the method of the first aspect by respective components (C) of the first and second members.

Said HIPed component may include a region (D) which is frusto-conical and may be defined in the method of the first aspect by respective components (D) of the first and second members.

Said HIPed component may include a region (E) which is frusto-conical and may be defined in the method of the first aspect by respective components (E) of the first and second members.

Said HIPed component may include a region (F) which is frusto-conical and may be defined in the method of the first aspect by respective components (F) of the first and second members.

Said HIPed component may include an outwardly facing convex curve defined between a pair of adjacent components selected from regions (A), (B), (C), (D), (E) and (F).

Said HIPed component may include an outwardly facing concave curve defined between a pair of adjacent components selected from regions (A), (B), (C), (D), (E) and (F).

Said HIPed component may include a plurality of concave curves as aforesaid. Said HIPed component may include a plurality of convex curves as aforesaid.

Said HIPed component is preferably fully dense.

Any feature of any aspect of any invention or embodiment described herein may be combined with any feature of any other invention or embodiment descried herein mutatis mutandis.

Specific embodiments of the invention will now be described, by way of example, with reference to the accompanying drawings in which.

Figure 2:
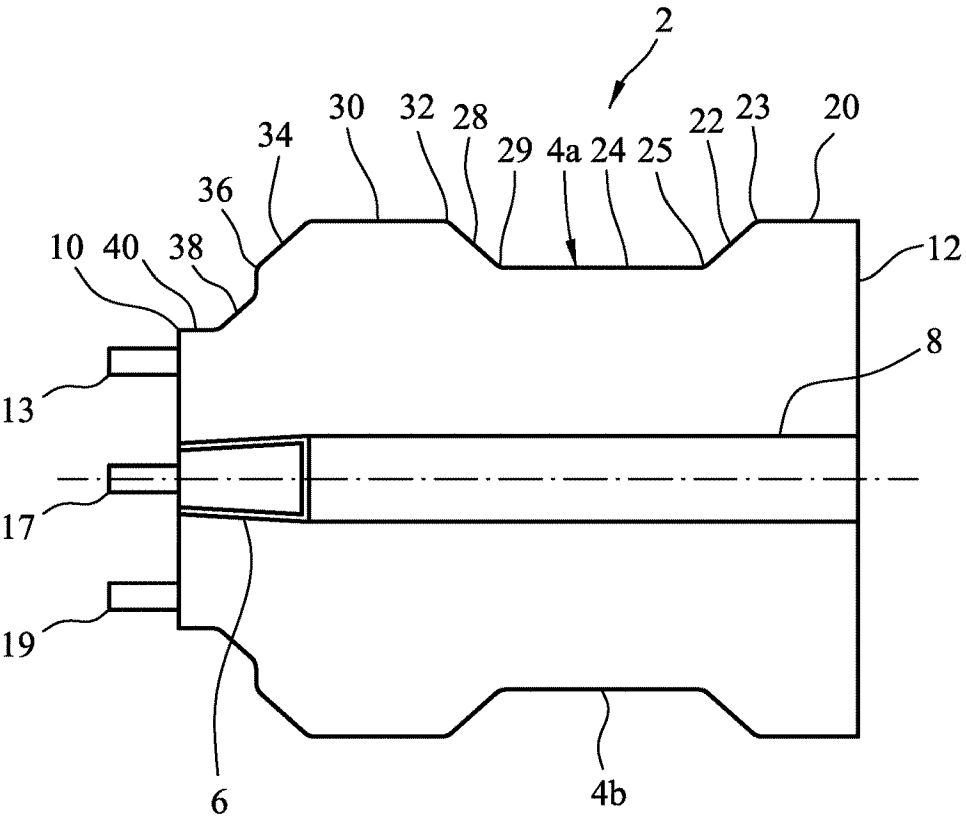
FIG. 2 is a cross-section along line II-II of FIG. 1.
Figure 1:
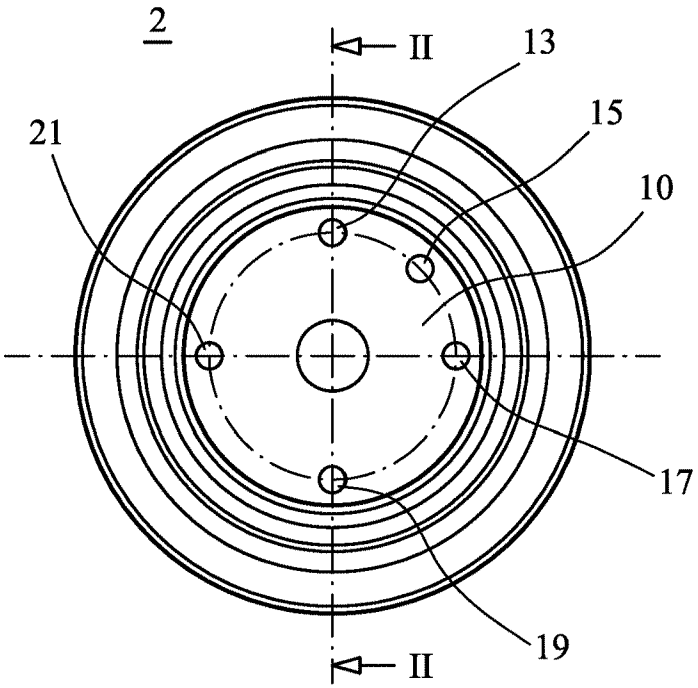
FIG. 1 is an end view of a capsule for HIP.
Figure 4B:
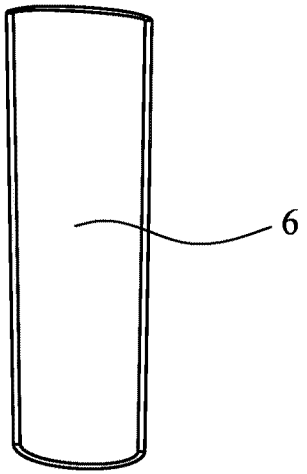
Figure 4C:
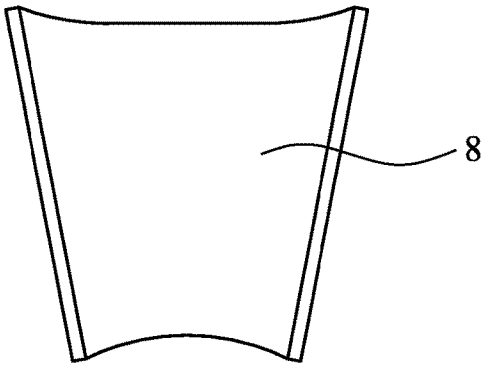
Figure 4A:
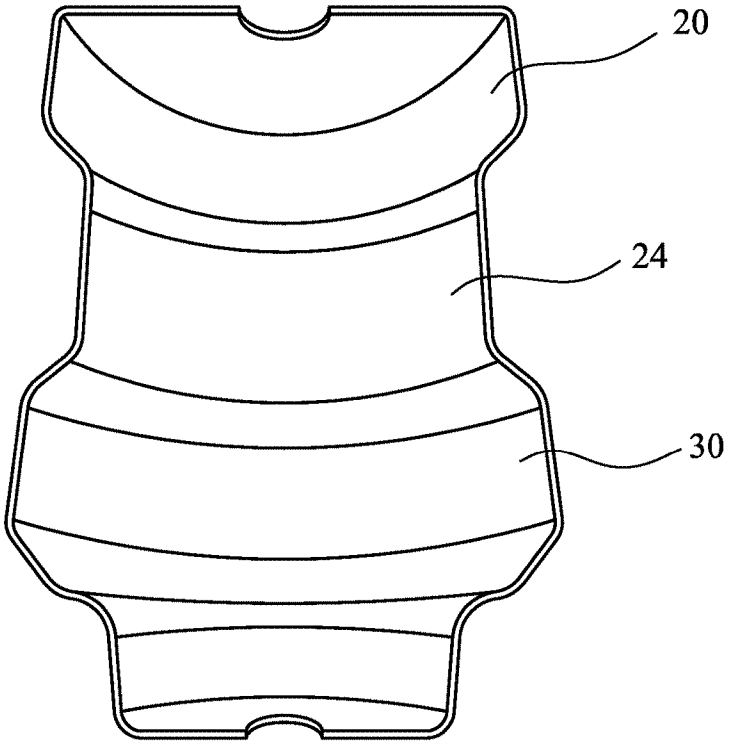

FIG. 4*a* is a side view of one half of an outer part of a capsule which is similar to the capsule of FIGS. 1 and 2;

FIG. 4*b* is a side view of one half of an inner tube of the capsule; and

FIG. 4*c* is a side view of one half of an inner cone of the capsule which is arranged to cooperate with the tube of FIG. 4*b* (although FIG. 4*c* is presented on a larger scale compared to FIG. 4*b*).

In the figures, the same of similar parts have the same reference numerals.

Figure 3:
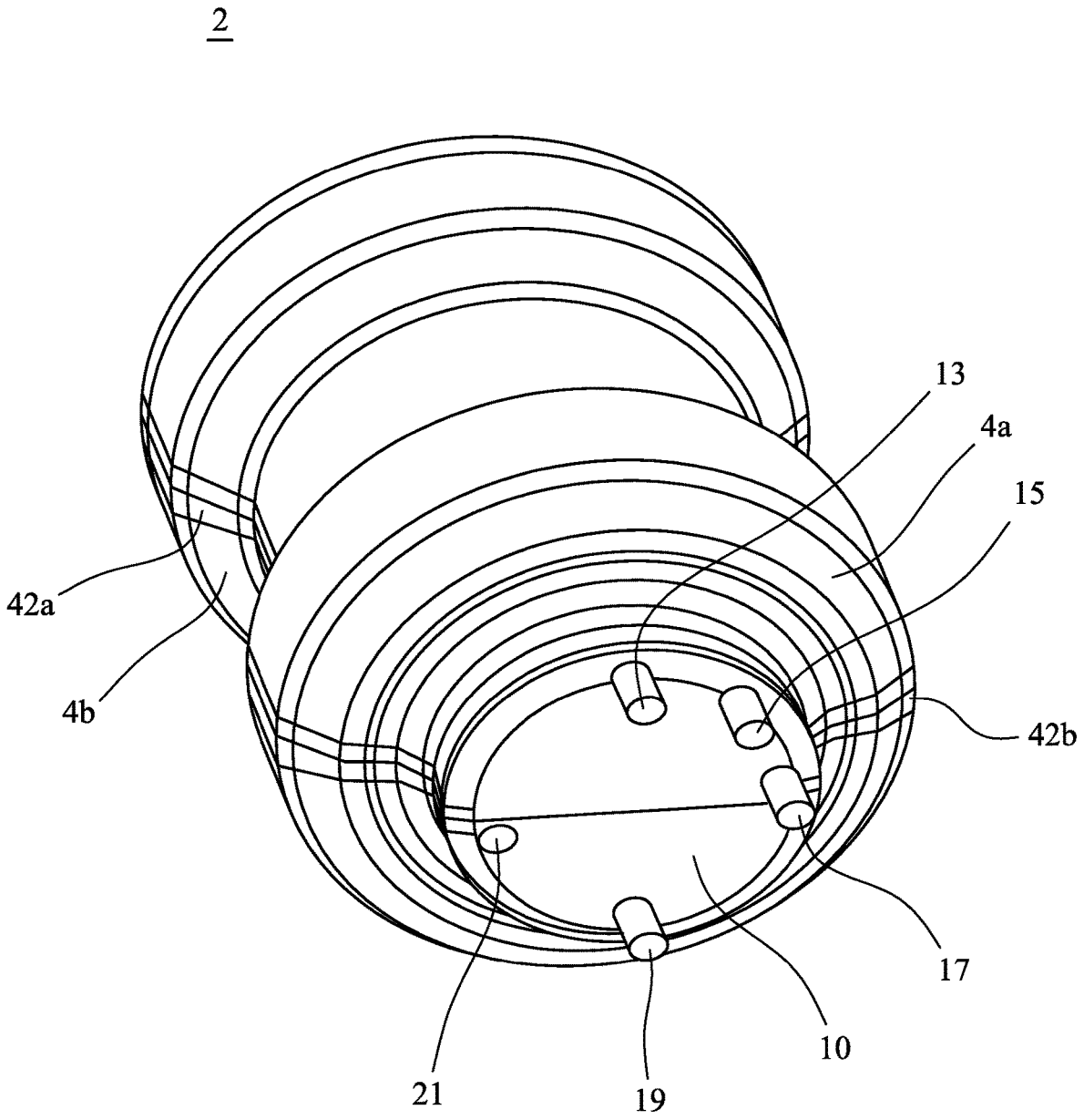
FIG. 3 is a perspective view of the capsule of FIGS. 1 and 2.

A capsule 2 for producing a relatively complex shaped final component comprises an identical pair of outer members 4*a*, 4*b* (FIG. 3) within which are secured an inner cylinder 6 and an inner cone 8. The capsule is closed by first end disc 10 at one end and second end disc 12 at an opposite end and shown in FIG. 3. The half capsule shown in FIG. 4*a* is similar to that shown in FIG. 3, except the FIG. 4*a* capsule does not include first and second end discs (10, 12) but, instead, includes preformed semi-circular ends 121, 123. Referring again to FIG. 3 respective tubes 13, 15, 17, 19, 21 extend through end disc 10 for introducing powdered metal into the capsule and/or for evacuating the capsule prior to hot isostatic pressing (HIP). The design of the capsule 2 may be produced with the help of Finite Element Analysis (FEA) so that the final component produced using the capsule is optimised.

Features of the capsule and its use are described in further detail below.

Outer member 4*a* is made from a single cold rolled steel sheet. The member is unitary and includes no weld lines. The member 4*a* is made by die forming methods. Hydroforming is a type of die forming which uses a high pressure hydraulic fluid to press the steel sheet, at ambient temperature (e.g. about 23° C.), into a die. Flexforming is similar except it uses a bladder containing a fluid which is used to urge the sheet steel into the die so the steel assumes the shape of the die.

Outer member 4*a* has a relatively complex shape which is defined in a single sheet of steel. At its end adjacent end disc 12 (or preformed end 121), the member 4*a* includes a wall section 20 which is substantially semi-cylindrical in shape. Moving leftwardly in the representation of FIG. 2, a semi-frusto conical section 22 is contiguous with wall section 20 and its outer surface is angled inwardly, relative to the outer surface of wall section 20, at an obtuse angle of about 225°. There is a smooth outwardly-facing convex curve 23 between respective sections 20, 22. Next, there is a wall section 24 which is substantially semi-cylindrical in shape and which has an outer surface which defines an angle of about 135° to conical section 22, there being a smooth, outwardly-facing concave curve 25 between respective sections.

Wall section 24 is contiguous with a semi-frusto conical section 28, the outer surface of which is angled at an angle of about 135° to the outer surface of wall section 24. A smooth, outwardly-facing concave curve 29 is defined between sections 24, 28.

Wall section 28 is contiguous with wall section 30 which is substantially semi-cylindrical in shape and which has an outer surface which defines an angle of about 225° to section 28, there being a smooth, outwardly-facing convex curve 32 between respective sections.

Between front end disc 10 (or preformed end 123) and wall section 30, outer member 4*a* is relatively more complex in shape. It includes a semi-frusto conical section 34 which is contiguous with section 30 at one end. At its opposite end, it is contiguous with a radially extending semi-annular section 36 which, in turn, is continuous with a semi-frusto conical section 38. Section 38 is contiguous with a semi-cylindrical section 40.

It will be appreciated that, between section 30 and disc 10 (or preformed end 123) of member 4*a*, there is a series of short sections which include both convex and concave curves between the sections.

Outer member 4*b* of the capsule is identical to member 4*a*. Together, outer members 4*a* and 4*b* represent identical halves which are arranged to define the majority and/or substantially the whole of a radially outwardly facing surface of a final component which is made using the capsule 2 in a HIP process.

In capsule 2, inner cylinder 6 and inner cone 8 are welded in position. Then, the two outer members 4*a* and 4*b* are abutted and welded to one another so that substantially straight, axially extending, diametrically-opposed weld seams 42*a*, 42*b* (FIG. 3) are defined on the outside of the capsule 2. Discs 10, 12 and associated tubes 13, 15, 17, 19, 21 (if provided) are also welded in position to define the completed capsule 2.

It should be appreciated that the capsule 2 can be assembled significantly more rapidly than an equivalent capsule which may comprise individual sections which are welded to define, for example, sections 20, 24, 28, 30, 34, 36, 38, 40. Furthermore, the number and/or total length of weld seams used to assemble capsule 2 will advantageously be significantly less than in an equivalent capsule which includes multiple individual sections to define, for example, sections 20, 24, 28, 30, 34, 36, 38, 40.

Minimising the number of weld seams may also help to minimise the amount of heat the capsule is subjected to during its manufacture. Welding subjects the capsule to heat which may distort the geometry of any weld and/or any part being welded. Thus, using outer members 4*a*, 4*b* (which incorporate complex geometry) may help to improve tolerances within the capsule and, consequently, in a final component formed using the capsule.

Furthermore, minimising the number of welds may minimise the overall error introduced into the capsule by virtue of the degree of error associated with each weld and may therefore reduce the number of capsules which are rejected for being outside design parameters upon post-welding inspection.

It is also found that, by reducing the complexity of weld seams required, a capsule produced is less susceptible to weakness and potential failure. For example, as described, between front end disc 10 (or preformed end 123) and wall section 30, outer member 4*a* (and identical outer member 4*b*) are relatively complex. Welding individual sections to define such complexity would be time-consuming and any defective weld would, in turn, lead to a defective capsule. Thus, by avoiding complex weld seams (or at least reducing their number/length) and providing outer members 4*a*, 4*b* as described, advantages may arise.

After construction of the capsule 2, it is evacuated by connecting a vacuum line to one or more of tubes 13, 15, 17, 19, 21 and then is subjected to helium leak testing to ensure it is gas-tight. Next, it is filled with powdered metal via one or more of the tubes.

The powdered metal may be selected from, but is not limited to, stainless steels including austenitic, ferritic and martensitic grades, duplex and super duplex stainless steels, Ni, Ti and CoCr alloys together with metal matrix composite alloys. The metal powder may be filled up to 100% volume of the void defined in capsule 2. The powder fill weight is calculated based on the capsule design and the particle size distribution of the metal powder. The metal powder is filled into the capsule to achieve a known powder fill weight and an optimum powder packing density.

After filling of the capsule 2, it is evacuated of entrapped air by connecting a vacuum line to one of the tubes and pulling a vacuum. Then, tubes are crimped to seal the assembly.

Next, the capsule 2 is subjected to HIP by placing it in a HIP system and subjecting it to a predetermined temperature and pressure for a predetermined time.

After HIP, the capsule is placed in a heat treatment furnace at a predetermined temperature for a predetermined time in order to achieve optimum material properties for the final component.

After HIP, parts of the capsule which are not to be included in the final component are removed. This may be done by immersion of the post-HIPed assembly in various acids and stages for a suitable time to dissolve away the sheet steel which encases the component. In particular, outer members 4*a*, 4*b* are dissolved away. After being HIPed, the powdered metal is fully dense and has a fine homogenous grain size.

In addition to advantages associated with the capsule itself, a final component made using outer members 4*a*, 4*b* may also exhibit advantages. In this regard, since the final component is made using a capsule which may have very tight tolerances, the final component made may likewise have tight tolerances. Furthermore, the amount of machining required, post-HIP, may be reduced, compared to the situation when known methods are used to make components. This may arise by virtue, for example, of being able to define rounded edges and/or corners of predetermined radii, as described.

Use of outer members 4*a*, 4*b* may also help to reduce weld imprints on the final component. For example, in known methods wherein some welds in a capsule are joined by parallel flanges, weld imprints may be clearly visible in the final component, because the flanges inevitably include some space which may fill with powder during manufacture. Such weld imprints may be minimised by use of the process described herein.

It may be possible, by inspection of a final component made using the process described, to confirm the final component has been made using a capsule including identical outer members 4*a*, 4*b* because the final component may include two parallel, axially extending, diametrically spaced apart lines or areas defined (or apparent) in the outer surface of the component.

Advantageously, once a die has been produced to enable formation of parts of a capsule, for example outer members 4*a*, 4*b*, the die may be used numerous times to produce a multiplicity of identical members for capsules which may, in turn, be used to produce a multiplicity of identical final components. Thus, the method described enables more consistent production of capsules and final components than hitherto.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. A method of making a capsule for hot isostatic pressing (HIPing), the method comprising:

(i) selecting a first sheet of metal;

(ii) subjecting the first sheet to a forming process thereby to define a first member of the capsule;

(iii) selecting a second sheet of metal;

(iv) subjecting the second sheet to a forming process thereby to define a second member of the capsule comprising first and second elongate edges;

(v) securing said first member to the second member thereby to define at least part of a capsule for HIPing, by abutting the first and second elongate edges of the first member against the first and second elongate edges of the second member and securing the abutting edges together by welding.

2. A method according to claim 1, wherein said first sheet of metal selected in step (i) has a thickness of at least 1 mm and a face having an area of at least 0.25 $m^2$ and less than 4 $m^2$; wherein, in step (ii), said first sheet is subjected to a forming process using a die; and wherein the method comprises using the same die to produce a plurality of substantially identical first members.

3. The method according to claim 1, wherein said first member includes no weld lines or welded areas and/or said first member has a substantially constant thickness across its extent.

4. The method according to claim 3, wherein said first member includes at least three, outwardly facing curved areas, and wherein one or a plurality of said curved areas is semi-circular in shape.

5. The method according to claim 4, wherein said first member includes a component (A) which is semi-cylindrical; and a component (B) which is semi-cylindrical; and a component (C) which is semi-cylindrical.

6. The method according to claim 5, wherein said first member includes a component (D) which is semi-frusto conical; and, optionally, includes a component (E) which is semi-frusto conical; and a component (F) which is semi-frusto conical.

7. The method according to claim 6, wherein said first member includes an outwardly facing convex curve defined between a pair of adjacent components selected from components (A), (B), (C), (D), (E) and (F).

8. The method according to claim 7, wherein said first member includes an outwardly facing concave curve defined between a pair of adjacent components selected from components (A), (B), (C), (D), (E) and (F).

9. The method according to claim 1, wherein said first member includes a plurality of concave curves and a plurality of convex curves and wherein said first member includes at least three bends, wherein each of said bends is the result of bending said first sheet through an angle in the range of 5 to 90°.

10. The method according to claim 1, wherein:

said second member includes no weld lines or welded areas and has a substantially constant thickness across its extent; and/or said second member includes at least three outwardly facing curved areas; and/or said second member includes one or a plurality of curved areas which are semi-circular in shape; and/or said second member include a component (A) which is semi-cylindrical; and a component (B) which is semi-cylindrical; and a component (C) which is semi-cylindrical.

11. The method according to claim 10, wherein said second member includes a component (D) which is semi-frusto conical; and/or a component (E) which is semi-frusto conical; and/or a component (F) which is semi-frusto conical; and said second member includes a plurality of concave curves and a plurality of convex curves.

12. A method according to any of claim 10, wherein the first and second sheets are subjected to substantially identical processes to produce a first member and second member which are substantially identical.

13. The method according to claim 10, wherein said first member and said second member each define shells which are secured to one another to define at least part of the capsule, wherein said first member includes a first elongate edge which is non-linear and which extends substantially within a single plane, said first member including a second elongate edge which is diametrically opposed to said first elongate edge, wherein said second elongate edge is non-linear and extends in a single plane which is the same plane in which the first elongate edge extends; wherein said first elongate edge of the second member is non-linear and which extends substantially within a single plane, said second elongate edge of said second member, is diametrically opposed to said first elongate edge, wherein said second elongate edge is non-linear and extends in a single plane which is the same plane in which the first elongate edge extends.

14. The method according to claim 1, wherein the capsule defines a substantially closed container which has fewer than ten weld lines which are externally visible on viewing the closed container, excluding any weld lines associated with any orifice(s) which is/are arranged to allow access into a void of the container.

15. The method according to claim 1, the method including arranging a structure within a void defined within the assembly comprising said first member and a or said second member, wherein the structure includes a cylindrical component and/or a frusto-conical component.

16. A capsule made as described in claim 1, wherein:

the capsule comprises a first member secured to one or more other members thereby to define at least part of a capsule for HIPing, wherein said first member includes no weld lines or welded areas, has a substantially constant thickness across its extent and includes at least three outwardly facing curved areas, wherein one or a plurality of said curved areas is part circular in shape;

the capsule comprises a second member wherein said second member includes no weld lines or welded areas, has a substantially constant thickness across its extent and includes at least three outwardly facing curved areas, wherein one or a plurality of said curved areas is part circular in shape;

in said capsule said first and second members are welded so that a gas tight seal is defined between the two members; and wherein said capsule is gas tight.

17. A method of producing a component (herein a "HIPed component"), the method comprising:

(i) selecting a capsule as claimed in claim 16;

(ii) subjecting the capsule to HIP.

18. The method according to claim 6, wherein:

said second member includes no weld lines or welded areas and has a substantially constant thickness across its extent;

said second member includes at least three outwardly facing curved areas;

said second member includes one or a plurality of curved areas which is semi-circular in shape;

said second member includes a component (A) which is semi-cylindrical; and a component (B) which is semi-cylindrical; and a component (C) which is semi-cylindrical.

19. The method according to claim 6, wherein said first member and said second member each define shells which are secured to one another to define at least part of the capsule, wherein said first member includes a first elongate edge which is non-linear and which extends substantially within a single plane, said first member including a second elongate edge which is diametrically opposed to said first elongate edge, wherein said second elongate edge is non-linear and extends in a single plane which is the same plane in which the first elongate edge extends; wherein said a first elongate edge of the first member is non-linear and extends substantially within a single plane, said second elongate edge of the second member, is diametrically opposed to said first elongate edge, wherein said second elongate edge is non-linear and extends in a single plane which is the same plane in which the first elongate edge extends.

20. The method according to claim 19, wherein the capsule defines a substantially closed container which has fewer than four weld lines which are externally visible on viewing the closed container, excluding any weld lines associated with any orifice(s) which is/are arranged to allow access into a void of the container; and wherein the first and second sheets are subjected to substantially identical processes to produce a first member and second member which are substantially identical.

* * * * *